US008403322B2

(12) United States Patent
Otsuki

(10) Patent No.: US 8,403,322 B2
(45) Date of Patent: Mar. 26, 2013

(54) SHEET FEED DEVICE

(75) Inventor: Yasuyuki Otsuki, Nagoya (JP)

(73) Assignee: Brother Kogyo Kabushiki Kaisha, Nagoya-Shi, Aichi-ken (JP)

( * ) Notice: Subject to any disclaimer, the term of this patent is extended or adjusted under 35 U.S.C. 154(b) by 0 days.

(21) Appl. No.: 12/873,754

(22) Filed: Sep. 1, 2010

(65) Prior Publication Data

US 2011/0156340 A1 Jun. 30, 2011

(30) Foreign Application Priority Data

Dec. 28, 2009 (JP) ..... 2009-297786

(51) Int. Cl.
*B65H 3/34* (2006.01)
*B65H 3/52* (2006.01)

(52) U.S. Cl. ..... 271/167; 271/121; 271/124

(58) Field of Classification Search ..... 271/124, 271/121, 109, 167
See application file for complete search history.

(56) References Cited

U.S. PATENT DOCUMENTS

| | | | | |
|---|---|---|---|---|
| 4,535,981 | A * | 8/1985 | Watanabe et al. | 271/121 |
| 4,815,724 | A * | 3/1989 | Sumida et al. | 271/121 |
| 5,370,381 | A * | 12/1994 | Winship et al. | 271/121 |
| 7,163,202 | B2 * | 1/2007 | Togashi et al. | 271/121 |
| 7,401,774 | B2 * | 7/2008 | Ginzton | 271/124 |
| 7,597,313 | B2 * | 10/2009 | Dan | 271/10.03 |
| 2002/0096819 | A1 * | 7/2002 | Fukasawa et al. | 271/121 |
| 2004/0065993 | A1 * | 4/2004 | Kamijoh | 271/121 |
| 2005/0001372 | A1 | 1/2005 | Yuza et al. | |
| 2005/0067758 | A1 * | 3/2005 | Seki et al. | 271/121 |
| 2006/0255526 | A1 | 11/2006 | Ginzton | |
| 2007/0108696 | A1 * | 5/2007 | Yorimoto | 271/121 |
| 2009/0001660 | A1 | 1/2009 | Miwa | |
| 2010/0156033 | A1 * | 6/2010 | Lee | 271/121 |

FOREIGN PATENT DOCUMENTS

| | | | |
|---|---|---|---|
| EP | 1721846 | A2 | 11/2006 |
| JP | H11-139577 | A | 5/1999 |
| JP | 2000-053268 | A | 2/2000 |

(Continued)

OTHER PUBLICATIONS

Japan Patent Office, Notification of Reason for Refusal for Japanese Patent Application No. 2009-297786, issued Dec. 6, 2011.

(Continued)

*Primary Examiner* — Patrick Cicchino
(74) *Attorney, Agent, or Firm* — Baker Botts L.L.P.

(57) ABSTRACT

A sheet feed device includes: a sheet accommodation unit; a separation roller that applies conveyance force to sheets; and a separation resistance body including a friction portion facing the separation roller for separating the sheets one at a time. The sheet accommodation unit includes a guide portion provided at an upstream of the separation roller in a sheet feed direction for guiding the sheet. The separation resistance body includes an extension portion, which is pressed toward the separation roller while being supported to be contacted/separated to/from the separation roller, and which is extended upstream in the sheet feed direction from an upstream end portion of the separation resistance body. The guide portion and the extension portion are arranged in a line in a width direction. An upstream end portion of the extension portion is retreated with regard to a guide surface of the guide portion when feeding the sheets.

12 Claims, 9 Drawing Sheets

FOREIGN PATENT DOCUMENTS

| | | | |
|---|---|---|---|
| JP | 2001-063854 | A | 3/2001 |
| JP | 2002-002995 | A | 1/2002 |
| JP | 2003-212376 | A | 7/2003 |
| JP | 2003-252468 | A | 9/2003 |
| JP | 2004-307200 | A | 11/2004 |
| JP | 2009-007123 | A | 1/2009 |
| JP | 2009-190869 | A | 8/2009 |

OTHER PUBLICATIONS

Japan Patent Office, Decision of Patent Grant for Japanese Patent Application No. 2009-297786, dispatched Feb. 28, 2012.

European Patent Office, extended European Search Report for European Patent Application No. 10009081.0, dated Aug. 21, 2012.

* cited by examiner

SHEET FEED DEVICE

CROSS-REFERENCE TO RELATED APPLICATIONS

This application claims priority from Japanese Patent Application No. 2009-297786 filed on Dec. 28, 2009, the entire subject matter of which is incorporated herein by reference.

TECHNICAL FIELD

The present invention relates to a sheet feed device that separates and feeds sheets one at a time.

BACKGROUND

An image forming apparatus such as laser printer and the like comprises a sheet feed device that separates and feeds sheets, which are stacked on a feeding tray, one at a time to an image forming unit. For example, in a known image forming apparatus, sheets stacked on a feeding tray are conveyed toward a separation pad having a friction portion by a feed roller, separated one at a time when they are sandwiched between a separation roller and the separation pad (friction portion) and then fed to an image forming unit.

SUMMARY

In a known sheet feed device, a leading end portion of the sheet conveyed by the feed roller is contacted to and jammed at an end portion of the separation pad, so that jamming or idle feeding of the sheet may occur. In addition, the sheet conveyed by the feed roller directly contacts and presses the separation pad, so that it is not possible to normally separate the sheets between the separation roller and the separation pad. As a result, the idle feeding or double feeding that a plurality of sheets is sent at a time may be caused.

Illustrative aspects of the invention provide a sheet feed device capable of suppressing jamming, idle feeding, double feeding and the like.

According to one illustrative aspect of the invention, there is provided a sheet feed device that separates and feeds sheets one at a time, the sheet feed device comprising: a sheet accommodation unit that accommodates the sheets; a separation roller that applies conveyance force to the sheets accommodated in the sheet accommodation unit; and a separation resistance body, which comprises a friction portion facing the separation roller, and which separates the sheets one at a time between the friction portion and the separation roller, wherein the sheet accommodation unit comprises a guide portion, which is extended along a sheet feed direction, which is provided at an upstream of the separation roller in the sheet feed direction, and which guides the sheet, wherein the separation resistance body comprises an extension portion, which is pressed toward the separation roller while being supported to be contacted/separated to/from the separation roller, and which is extended upstream in the sheet feed direction from an upstream end portion of the separation resistance body, wherein the guide portion and the extension portion are arranged in a line in a width direction that is substantially perpendicular to the sheet feed direction, wherein the guide portion comprises a guide surface that guides the sheets, and wherein an upstream end portion of the extension portion in the sheet feed direction is retreated with regard to the guide surface of the guide portion at least when feeding the sheets.

According thereto, since the sheets stacked on the sheet accommodation unit are contacted to the guide portion mounted to the sheet accommodation unit, the sheets do not directly press the separation resistance body. Then, the sheets are conveyed between the separation roller and the extension portion (separation resistance body) while being guided by the guide portion and contacted to the extension portion. At this time, since an upstream end portion of the extension portion with regard to the sheet feed direction is retreated with respect to a guide surface of the guide portion, on which the sheets are guided, the leading end portion of the sheet is conveyed without being jammed at an end portion of the separation resistance body. Thus, it is possible to suppress the jamming, idle feeding or double feeding of the sheets.

DETAILED DESCRIPTION

Exemplary embodiments of the invention will now be described with reference to the drawings. In the following descriptions, a structure of a laser printer (image forming apparatus) 1 having a sheet feed device (feed device 3) according to an exemplary embodiment of the invention will be first schematically explained and then a detailed structure of the feed device 3 will be explained.

<Laser Printer>

(Schematic Structure of Laser Printer)

Figure 1:
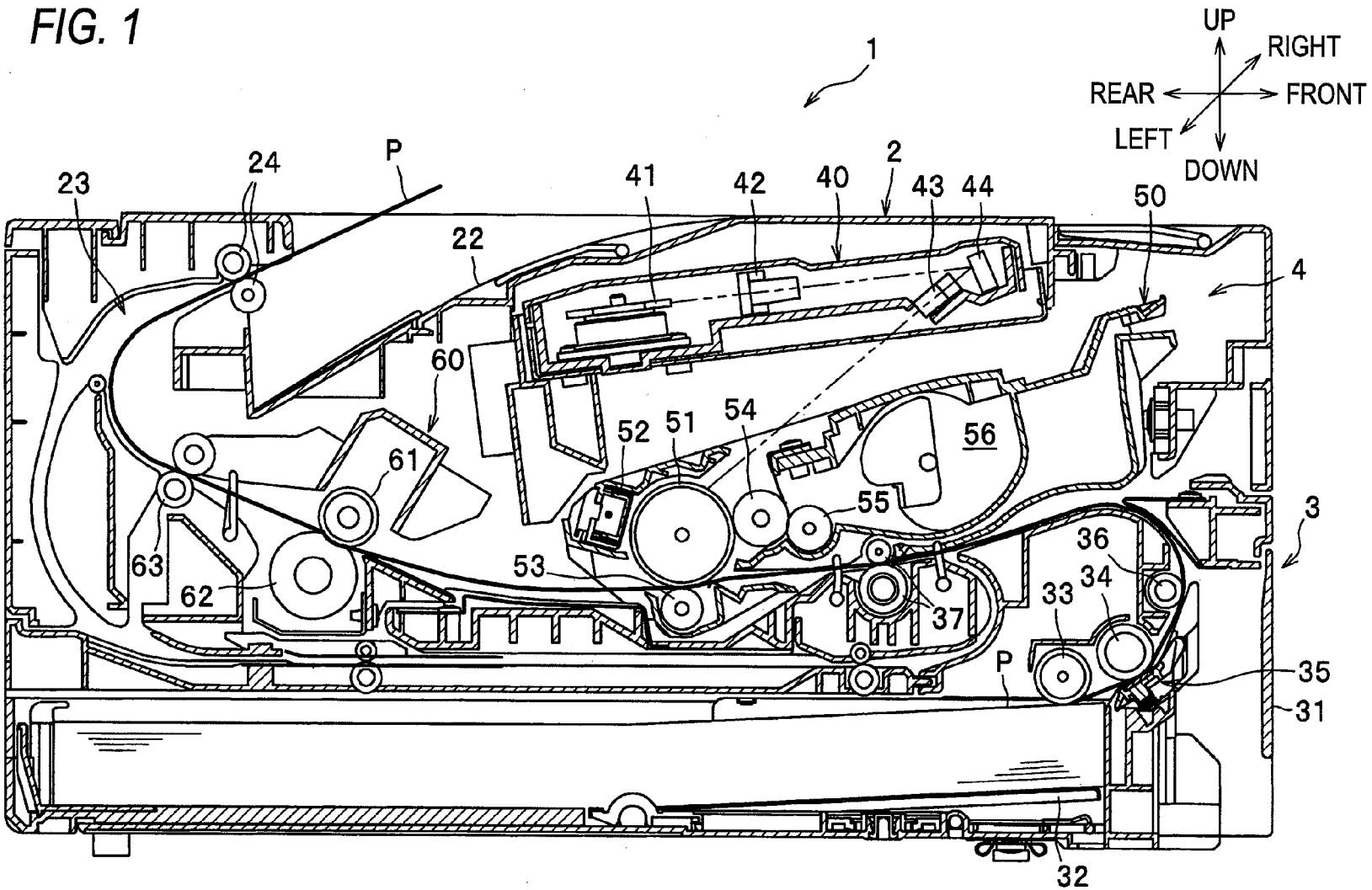
FIG. 1 shows a schematic structure of a laser printer having a sheet feed device according to an exemplary embodiment of the invention.

As shown in FIG. 1, a laser printer 1 includes: a body housing 2; a feed device 3 that feeds a sheet P; and an image forming unit 4 that forms an image on the fed sheet P. Incidentally, in this exemplary embodiment, the body housing 2 also serves as a housing of the feed device 2.

In the following descriptions, a direction is based on a user who uses the laser printer 1. In other words, directions as used herein refer to directions indicated by the arrows as indicated in each of the accompanying drawings. That is, a right side in FIG. 1 is referred to as "front," a left side is referred to as "rear," a front side is referred to as "left" and a rear side is referred to as "right." In addition, up-down direction in FIG. 1 is referred to as "up" and "down".

(Feed Device)

The feed device 3 is mounted at a lower part of the laser printer 1. The feed device 3 includes: a sheet tray 31 (one example of a sheet accommodation unit) that accommodates sheets P; a sheet pressing plate 32; a feed roller 33; a separation roller 34; a separation pad 35 (one example of a separation resistance body); a conveyance roller 36; and a registration roller 37.

The sheets P accommodated in the sheet tray 31 are pressed toward the feed roller 33 by the sheet pressing plate 32 and fed toward the separation pad 35 by the feed roller 33. The sheets P are separated one at a time by the separation roller 34 and the separation pad 35 and then conveyed toward the image forming unit 4, which is provided between a photosensitive drum 51 and a transfer roller 53, by the conveyance roller 36 and the registration roller 37.

(Image Forming Unit)

The image forming unit 4 includes: an exposure device 40; a process cartridge 50; and a fixing device 60.

The exposure device 40 is provided at an upper part in the body housing 2. The exposure device 40 includes: a laser light emitting portion (not shown); a polygon mirror 41 that is rotatably driven; lenses 42, 43; and a reflector 44. The laser light dotted lines in FIG. 1), which is based on image data, and which is emitted from the laser light emitting portion, is reflected or passes in an order of the polygon mirror 41, the lens 42, the reflector 44 and the lens 43, and then is incident on a surface of the photosensitive drum 51 at high speed.

The process cartridge 50 is arranged under the exposure device 40. The process cartridge 50 can be exchanged by mounting and removing the cartridge to and from the body housing 2 through an opening that is formed when a front cover (now shown) provided to the body housing 2 is opened. The process cartridge 50 includes: the photosensitive drum 51; a charger 52; the transfer roller 53; a developing roller 54; a supply roller 55; and a toner accommodating portion 56 that accommodates toner (developer).

The fixing device 60 is provided at a rear part of the process cartridge 50. The fixing device includes: a heating roller 61; and a pressing roller 62, which faces the heating roller 61, and which presses the heating roller 61.

In the image forming unit 4, a surface of the photosensitive drum 51 is uniformly charged by the charger 52 and exposed by a high-speed scanning of the laser light from the exposure device 40, so that an electrostatic latent image is formed on the photosensitive drum 51. The toner in the toner accommodating portion 56 is supplied to the developing roller 54 by using the supply roller 55 and then carried on the developing roller 54.

The toner carried on the developing roller 54 is supplied to the electrostatic latent image on the photosensitive drum 51, so that the electrostatic latent image becomes a visible image and a toner image is thus formed on the photosensitive drum 51. Then, the sheet P fed from the feed device 3 is conveyed between the photosensitive drum 51 and the transfer roller 53, so that the toner image on the photosensitive drum 51 is transferred on the sheet P.

The sheet P, on which the toner image is transferred, is conveyed between the heating roller 61 and the pressing roller 62, so that the toner image is heat-fixed. The sheet P, on which the toner image is heat-fixed, is conveyed through a conveyance path 23 by the conveyance roller 63 and then discharged on a sheet discharge tray 22 from the conveyance path 23 by a discharge roller 24.

<Detailed Structure of Feed Device>

A detailed structure of the feed device 3 will be described. Incidentally, in the following descriptions, a direction (sheet feed direction) in which the sheet P is fed from the feed device 3 (sheet tray 31) toward the image forming unit 4 (between the photosensitive drum 51 and the transfer roller 53) is simply referred to as "feed direction." In addition, an upstream of the feed direction is simply referred to as "upstream" and a downstream of the feed direction is simply referred to as "downstream." Additionally, a width direction (the left and right direction) of the sheet P stacked on the sheet tray 31 is often referred to as "width direction." Incidentally, the width direction may be substantially perpendicular to the sheet feed direction.

The feed device 3 is configured to separate and feed the stacked sheets P one at a time to the image forming unit 4. As described above, the feed device 3 includes the sheet tray 31, the feed roller 33, the separation roller 34 and the separation pad 35.

The feed roller 33 is configured to send the sheets P accommodated in the sheet tray 31 toward the separation pad 35. The feed roller 33 is provided in the body housing 2.

The separation roller 34 is configured to apply conveyance force to the sheet P. The separation roller 34 is provided in the body housing 2 at a position that is substantially front of the feed roller 33. The separation roller 34 and the feed roller 33 are configured to be rotated with driving force applied when feeding the sheet P.

Figure 2:
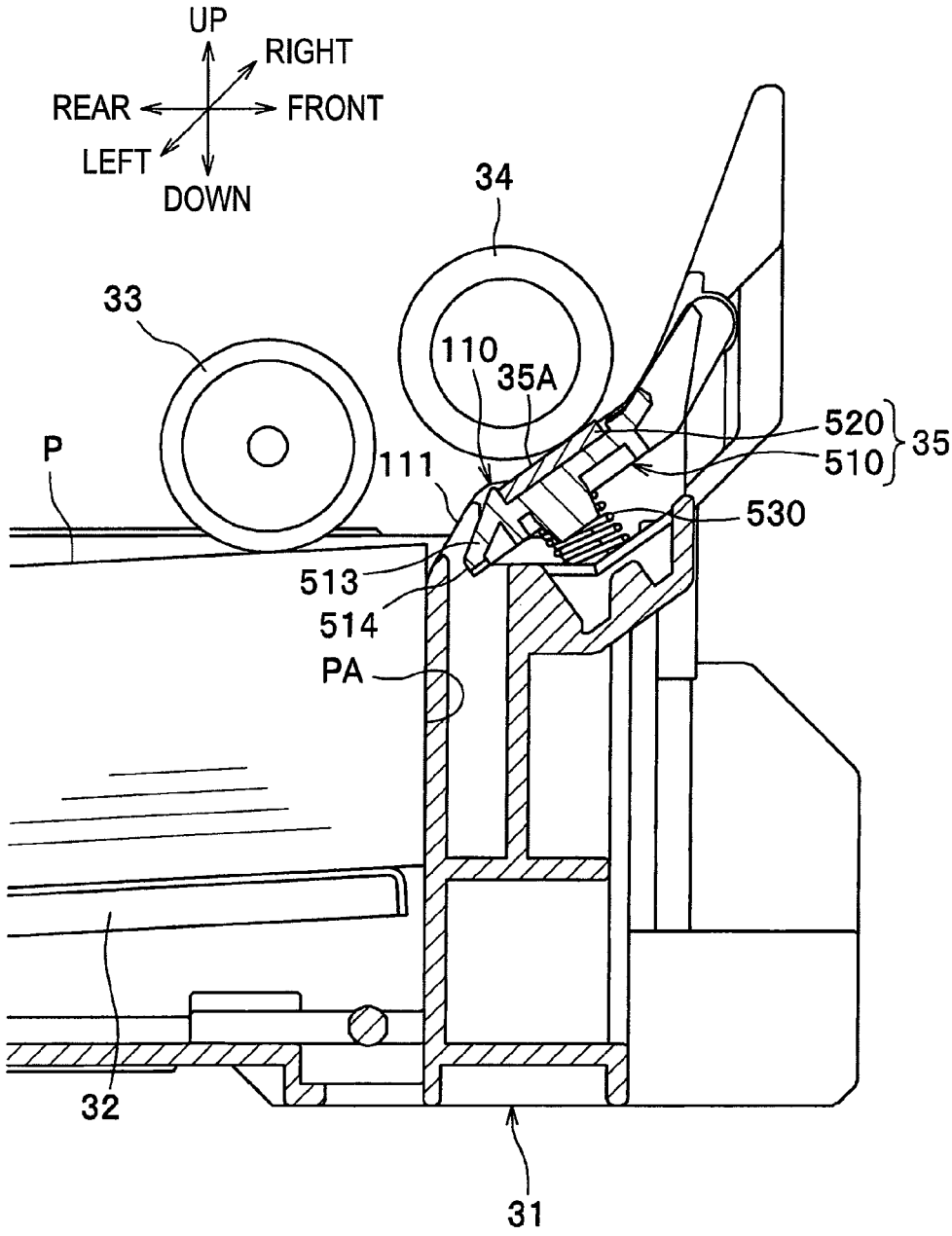
FIG. 2 is an enlarged view of a separation pad and guide portions of the sheet feed device when a sheet tray is located at a reception position.
Figure 3:
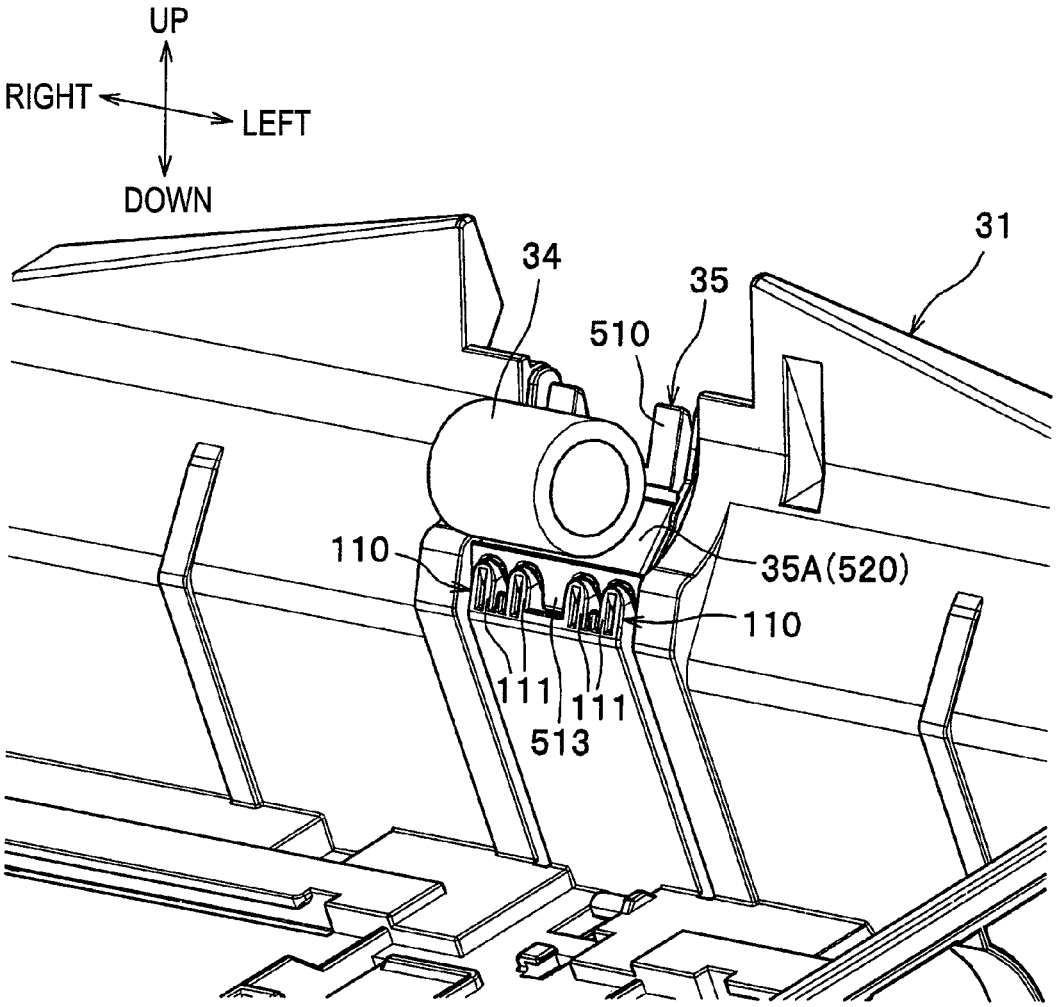
FIG. 3 is a perspective view of the separation pad and the guide portions when the sheet tray is located at the reception position.

As shown in FIGS. 2 and 3, the separation pad 35 includes a friction portion 35A that faces the separation roller 34. The separation pad 35A is configured to separate the sheets P one at a time between the friction portion 35A and the separation roller 34. The separation pad 35A is provided at a position substantially center of the front side of the sheet tray 31. The separation pad 35 includes a holder 510 and a friction sheet 420. The friction sheet 420 configures the friction portion 35A.

Figure 4:
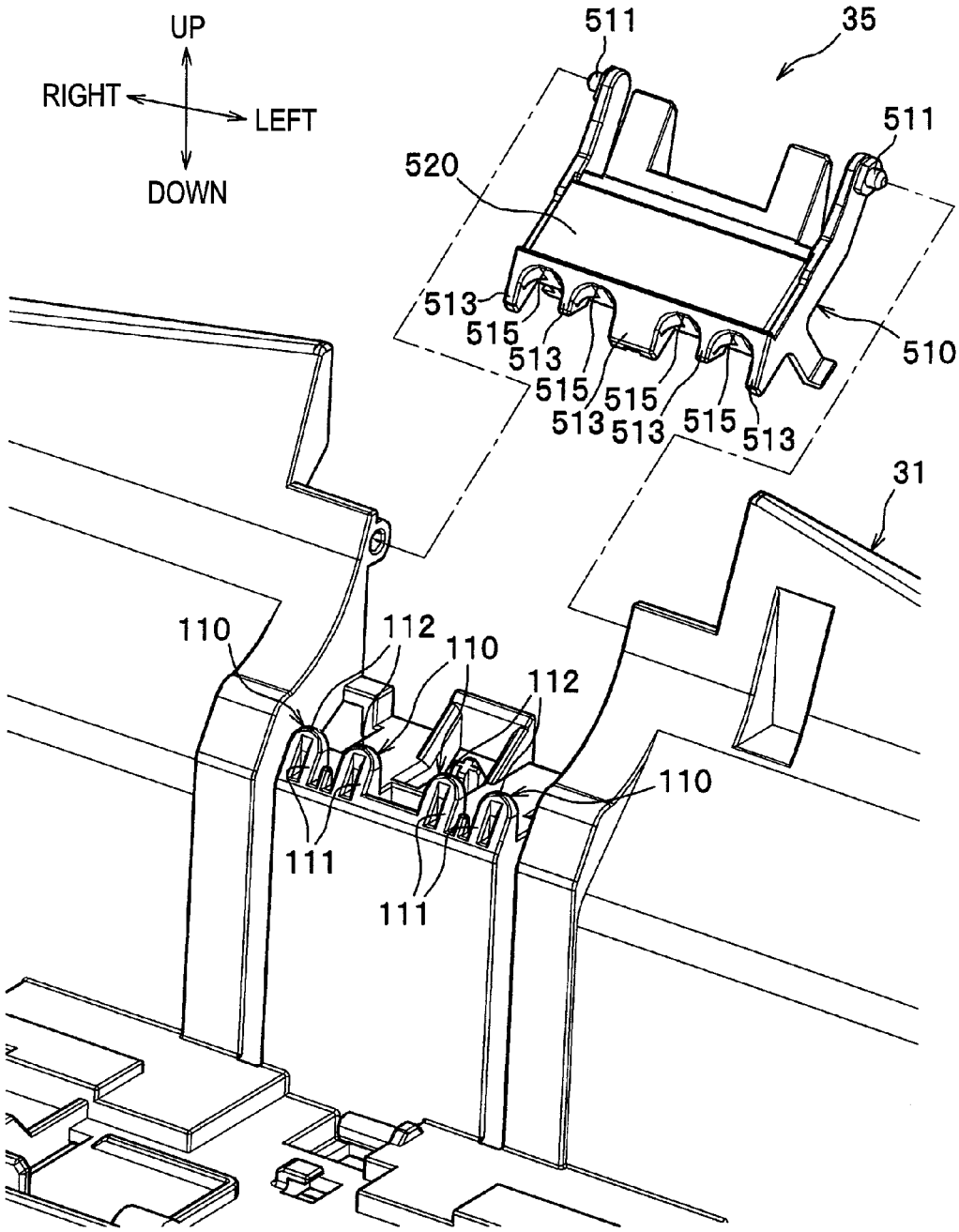
FIG. 4 is an exploded perspective view of the sheet tray and the separation pad.

As shown in FIG. 4, swing shafts, which extend right and left directions, are provided at downstream end portions (upper end portions) of the holder 510. The swing shafts 511 are supported at the sheet tray 31, so that an upstream end portion (lower end portion) of the holder 510 can be substantially swung in the up and down directions. Thereby, the separation pad 35 can be moved (contacted/separated) between directions of approaching and going away to and from the separation roller 34.

The sheet tray 31 includes a spring 530 (refer to FIG. 2). The upstream end portion of the holder 510 is pressed upward by the spring 530, so that the separation pad 35 (friction portion 35A) is pressed toward the separation roller 34. Incidentally, an upper surface of the holder 511 has a recess portion (reference numeral thereof is omitted) for attaching the friction sheet 520.

The friction sheet 520 is a sheet-shaped member made of a material having a high friction coefficient such as rubber, cork and the like. The friction sheet 520 is attached to the recess portion of the holder 510 by adhesion and the like. An upper surface of the friction sheet 520 attached to the holder 510 serves as the friction portion 35A that separates the sheets P one at a time between the separation roller 34 and the upper surface by being pressed by the separation roller 34.

Figure 5:
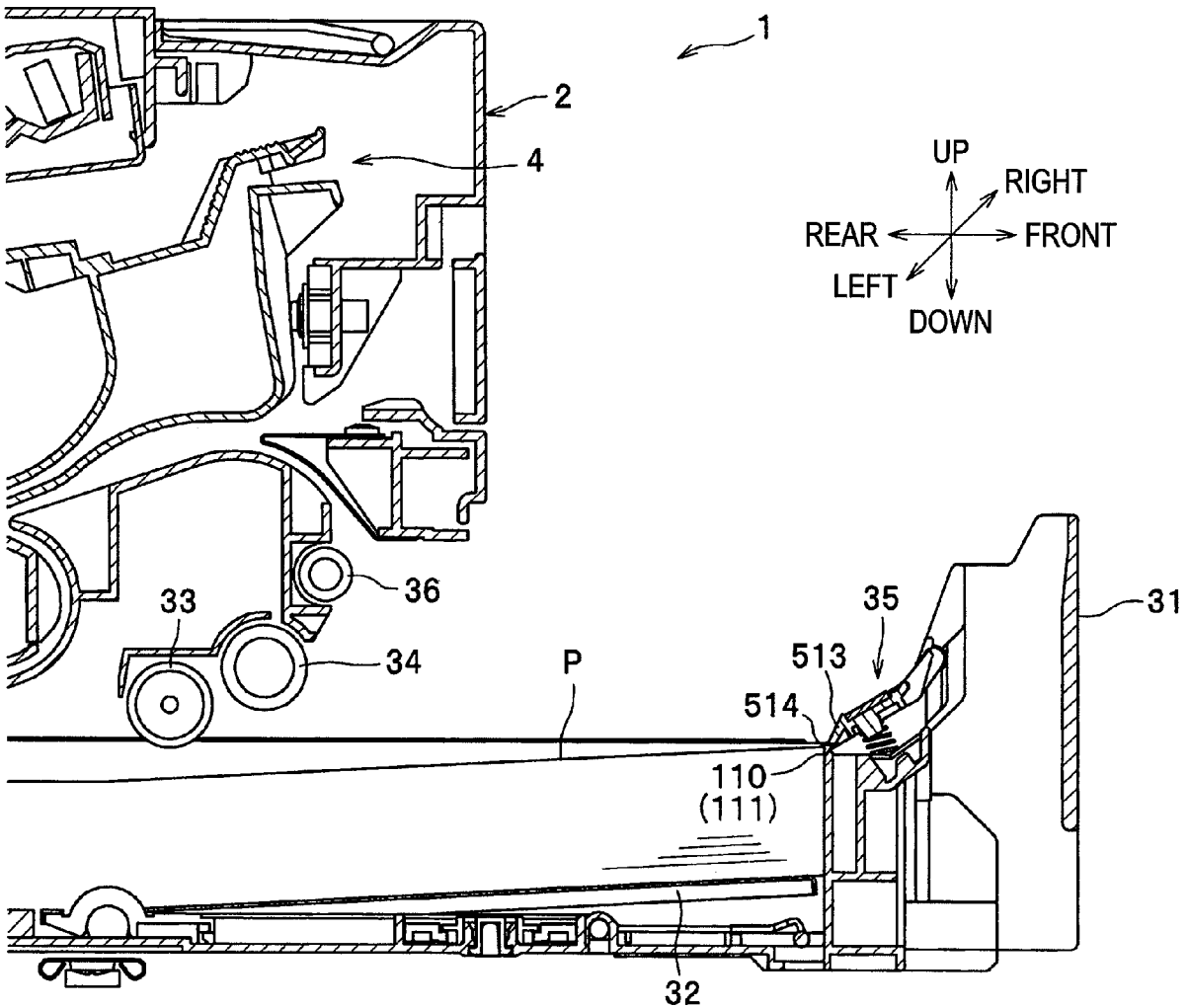
FIG. 5 shows a state in which the sheet tray is pulled out to a separation position.

The sheet tray 31 is a box-shaped member having an opened upper part, on which the sheets P are stacked. As shown in FIG. 5, the sheet tray 31 is mounted to and removed from the body housing 2 by pushing and pulling out the tray rearward and forward. To be more specific, the sheet tray 31 can be moved between a reception position, at which the separation pad 35 is pressed by the separation roller 34 (refer to FIGS. 1 to 3), and a separation position, at which the separation pad 35 is spaced from the separation roller 34 provided to the body housing 2 (refer to FIGS. 5 and 6) by pushing and pulling out the sheet tray 31 rearward and forward with regard to the body housing 2.

(Separation Pad and Sheet Tray)

In the followings, detailed structures of the separation pad 35 and the sheet tray 31 will be described.

As shown in FIG. 4, the separation pad 35 includes an extension portion 513 at an upstream end portion thereof. The extension portion 513 extends in the upstream direction. A plurality of the extension portions 513 is provided in the width direction and forms a shape of substantially teeth of a comb.

In addition, the sheet tray 31 includes a guide portion 110 at a center of a front wall portion thereof. The guide portion 110 extends obliquely upward along the feed direction from the front end portion PA of the stacked sheet P (refer to FIG. 2). A plurality of the guide portions 110 is provided in the width direction and forms a shape of substantially the teeth of the comb.

The guide portions 110 guide the sheet P, which is conveyed by the feed roller 33, toward the separation roller 34. By providing the guide portions 110, the sheet P, which is sent by the feed roller 33, is first contacted to the guide portions 110 and then guided toward the separation roller 34 along upper surfaces (guide surfaces 111) of the guide portions 110. Incidentally, the guide portions 110 are provided at an upstream of the separation roller 34 in the sheet feed direction.

As shown in FIGS. 3 and 8, under a state that the separation pad 35 is attached to the sheet tray 31, the guide portions 110 of the sheet tray 31 and the extension portions 513 of the separation pad 35 are alternately arranged in the width direction. In other words, the guide portions 110 and the extension portions 513 are shape like the teeth of the comb and are disposed to engage with each other. At this time, when seen from the width direction, the guide portions 110 and the extension portions 513 do not contact each other and are overlapped with each other as shown in FIG. 2.

Figure 7:
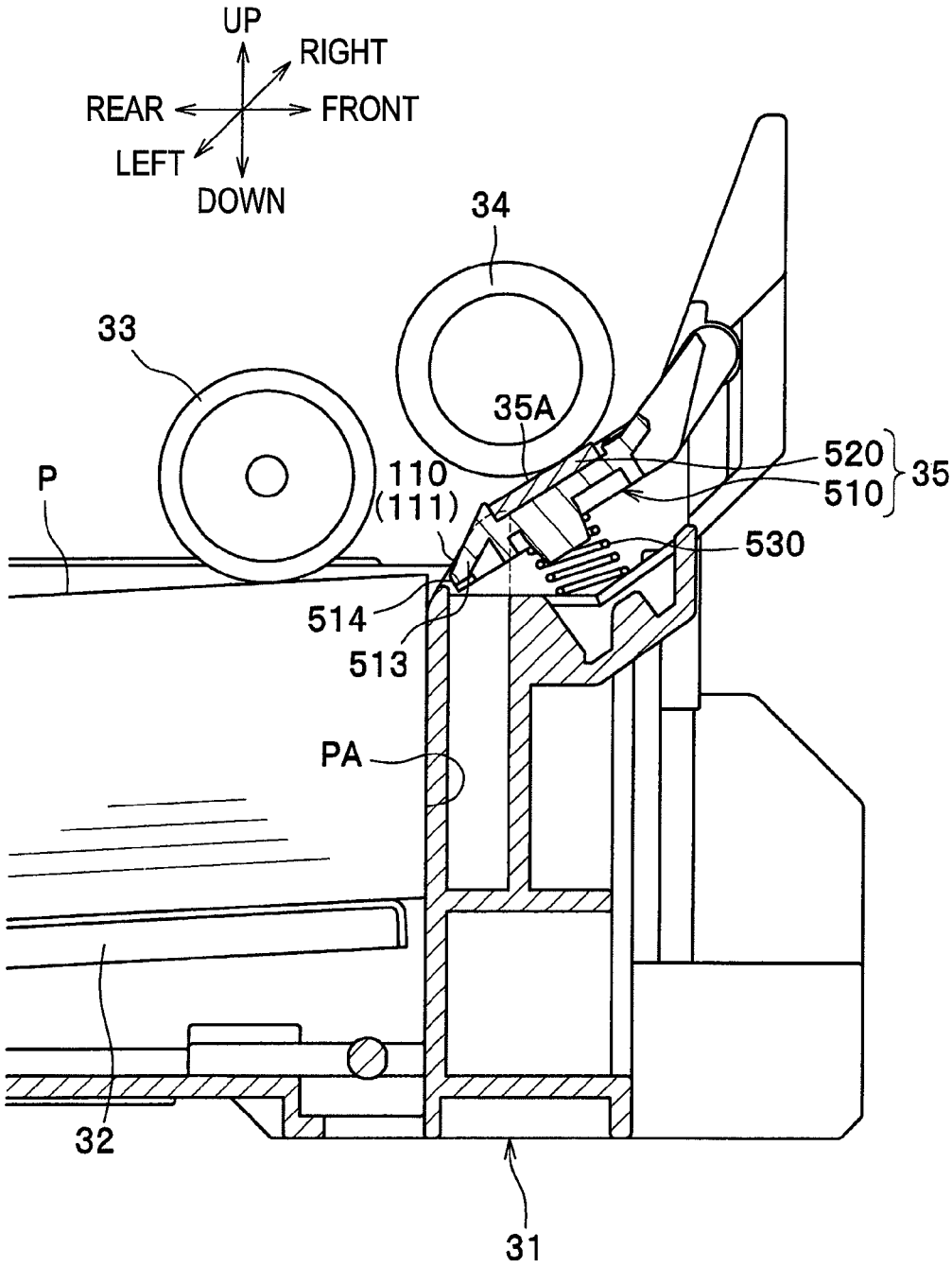
FIG. 7 is an enlarged view of the separation pad and the guide portions when the sheet tray is located at the reception position.

Further, as shown in FIGS. 2 and 7, when feeding the sheets P, that is, when the sheet tray 31 is located at the reception position at which the tray is mounted to the body housing 2, upstream end portions 514 of the extension portions 513 are retreated with regard to the guide surfaces 111, on which the sheet P is guided, of the guide portions 110.

Incidentally, under a state shown in FIG. 2, the whole of the extension portions 513 as well as the upstream end portions 514 is retreated with regard to the guide surfaces 111. Under a state shown in FIG. 7, the upstream portions of the extension portions 513 including the upstream end portions 514 are retreated with regard to the guide surfaces 111 and the downstream portions of the extension portions 513 are slightly protruded from the guide surfaces 111. The states shown in FIGS. 2 and 7 will be more specifically described later.

Figure 6:
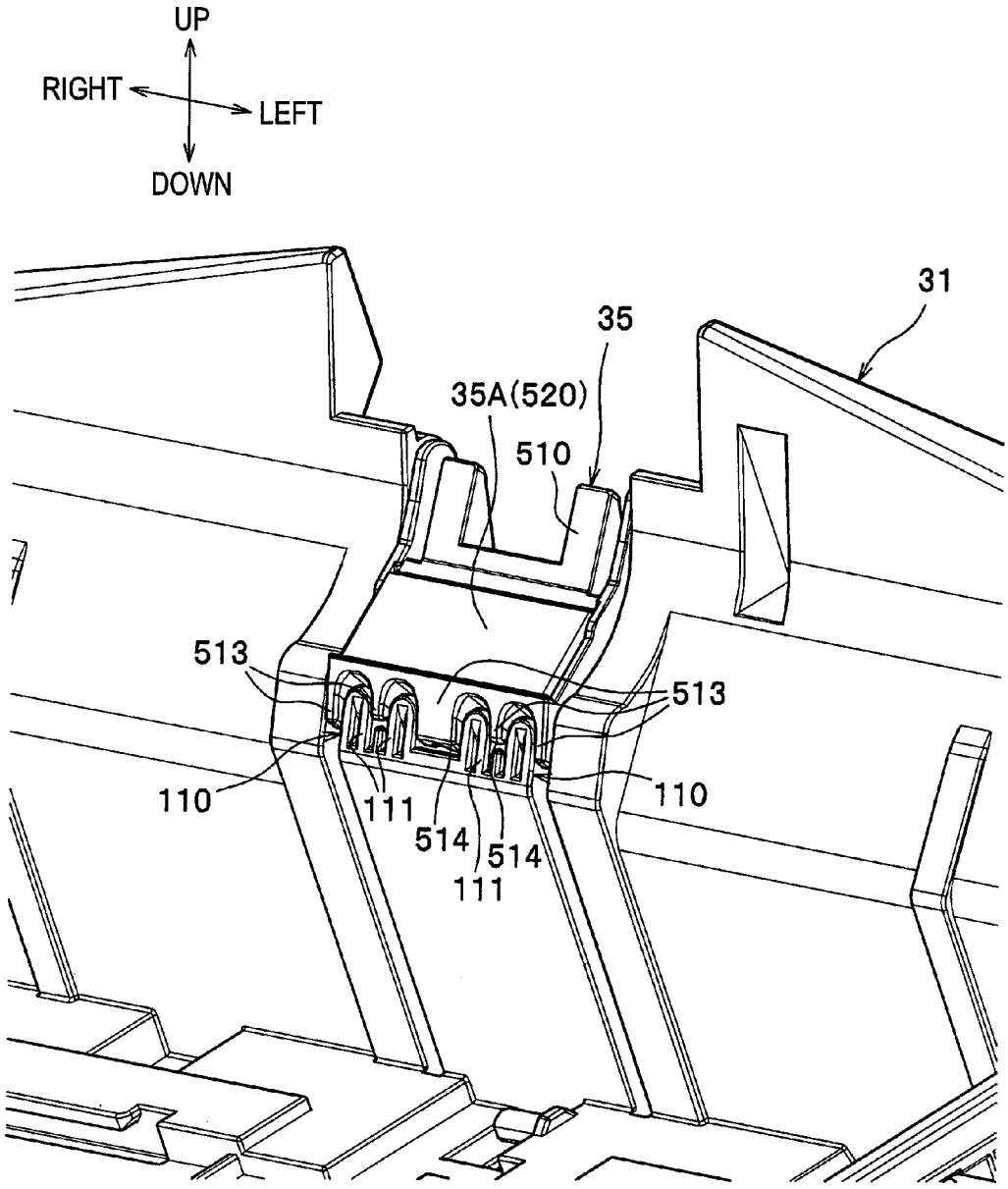
FIG. 6 is a perspective view of the separation pad and the guide portions when the sheet tray is located at the separation position.

Incidentally, in this exemplary embodiment, when the sheet tray 31 is at the separation position at which it is pulled out from the body housing 2, as shown in FIGS. 5 and 6, the holder 510 is pressed upward by the spring 530, so that a part of the upstream end portions 514 of the extension portions 513 are slightly protruded from the guide surfaces 111. Alternatively, even when the sheet tray 31 is at the separation position, the upstream end portions 514 may be retreated with respect to the guide surfaces 111.

Figure 8A:
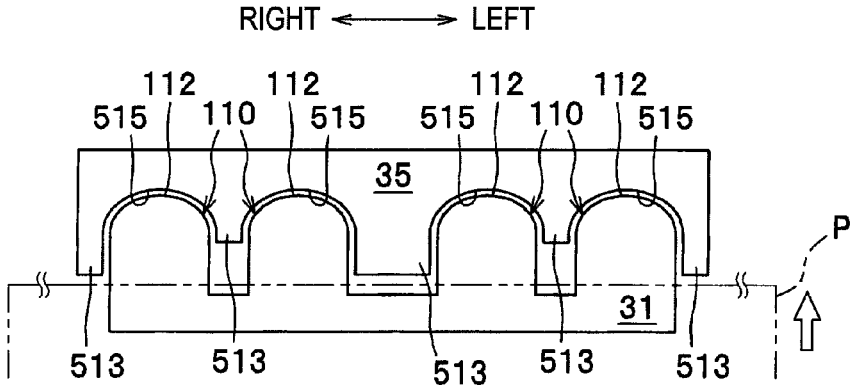
FIGS. 8A to 8D show an operation of extension portions.

As shown in FIG. 8A, in this exemplary embodiment, the separation pad 35 (holder 510) has a curved shape such that facing portions 515 facing downstream end portions 112 of the guide portions 110 are protruded downstream. In addition, the downstream end portions 112 of the guide portions 110 have curved shapes following the shapes of the facing portions 515.

In the followings, an operation of conveying the sheets P stacked on the sheet tray 31 between the separation roller 34 and the separation pad 35 (friction portion 35A) will be described to explain operational effects of the feed device 3 according to this exemplary embodiment.

As shown in FIG. 2, the sheets P sent by the feed roller 33 are contacted to the guide portions 110 of the sheet tray 31. Then, the sheets P are guided toward the separation roller 34 along the guide portions 110 (guide surfaces 111) and conveyed between the separation roller 34 and the separation pad 35. Accordingly, the sheets P are separated one at a time.

Under a state shown in FIG. 2, since the whole of the extension portions 513 is retreated with regard to the guide surfaces 111, the sent sheet P is guided by the guide surfaces 111 without contacting the extension portions 513 (separation pad 35), so that the sheet P is guided between the separation roller 34 and the separation pad 35. According to such structure, since the sheet P conveyed along the feed roller 33 does not directly press the separation pad 35, the sheets P can be normally separated, and thus it is possible to prevent the idle feeding or double feeding. In addition, since the leading end portion of the sheet P is not jammed at the separation pad 35, it is possible to suppress the jamming or idle feeding.

Here, FIG. 2 shows the most preferable position relation between the guide portions 110 (guide surfaces 111) of the sheet tray 31 and the separation pad 35 (extension portions 513). However, when the sheet tray 31 is moved to the reception position from the separation position or due to the inevitable error of parts (for example, holder 510), the position relation between the guide portions 110 and the separation pad 35 may be changed. As a result, it may not be possible to maintain the state in which the whole of the extension portions 513 is retreated with respect to the guide surfaces 111.

Even in this case, in the feed device 3, as shown in FIG. 7, at least the upstream ends 514 of the extension portions 513 are retreated with respect to the guide surfaces 111 when feeding the sheets P. Thus, since the sheet P sent by the feed roller 33 is first contacted to the guide portions 110, the sheet P does not directly press the separation pad 35. Then, the sheet P is contacted to the extension portions 513 while being guided by the guide surfaces 111 of the guide portions 110 and is conveyed between the separation roller 34 and the friction portion 35A while being guided by the upper surfaces of the extension portions 513 and is then separated one at a time.

As described above, in the feed device 3, since the sheet P conveyed by the feed roller 33 does not directly press the separation pad 35, it is possible to normally separate the sheets P and thus to suppress the idle feeding or double feeding. Further, in the feed device 3, since the upstream end portions 514 of the extension portions 513 are always retreated with respect to the guide surfaces 111 when feeding the sheets P, the sheet P is conveyed while the leading end portion thereof is not jammed at the upstream end portions 514 that are the end portions of the separation pad 35. Thus, it is possible to suppress the jamming or idle feeding.

Incidentally, in this exemplary embodiment, the facing portions 515 of the separation pad 35 are protruded downstream so as to have a curved shape. Therefore, it is possible to gradually bring the leading end portion of the sheet P to the extension portions 513 from the guide portions 110. To be more specific, the sheet P, which is guided by the guide portions 110 (guide surfaces 111) as shown in FIG. 8A, is contacted to the extension portions 513 and is also guided by the extension portions 513, as shown in FIG. 8B.

Figure 8B:
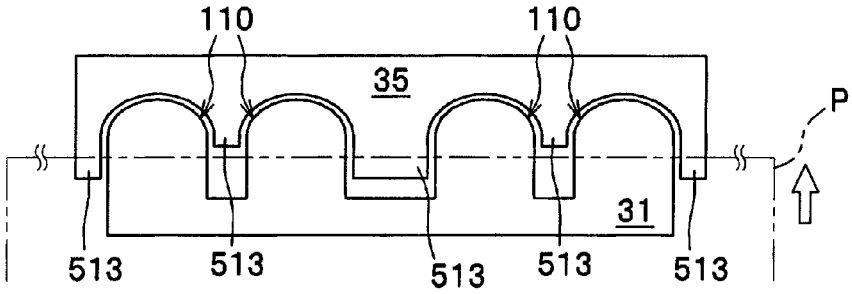
Figure 8C:
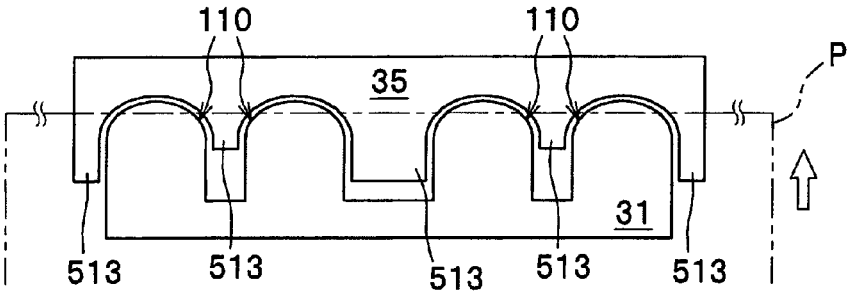

At this time, since the facing portions 515 have the curved shapes so as to be protruded downstream, the contact area between the leading end portion of the sheet P and the extension portions 513 are gradually increased as the conveyance process from a state of FIG. 8B to a state of FIG. 8C. Thus, the sheet P is gradually contacted to the extension portions 513. According thereto, it is possible to smoothly convey the sheet P, compared to a case where the contact area between the leading end portion of the sheet P and the extension portions 513 are rapidly increased.

Figure 8D:
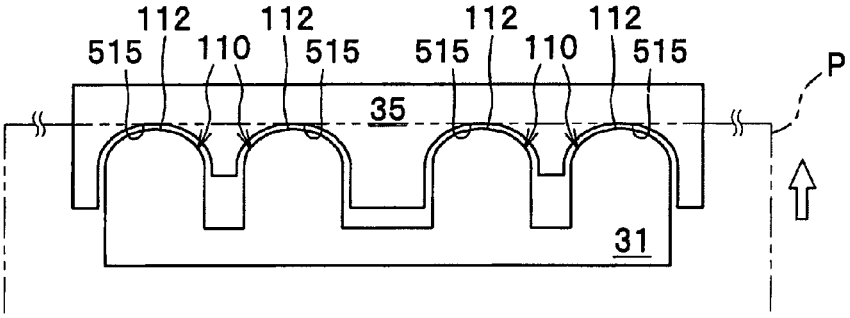

In addition, since the facing portions 515 have the curved shapes, it is possible to reduce the contact area between the leading end portion of the sheet P and ends of the facing portions 515, as shown in FIG. 8D. According to such a structure, since it is possible to reduce an area of a part to which the leading end portion of the sheet P is vertically contacted, it is possible to prevent the sheet P from being jammed and thus to suppress the jamming or idle feeding.

Further, in this exemplary embodiment, since the downstream end portions of the guide portions 110 have the curved shapes following the shapes of the facing portions 515, it is possible to minimize a gap between the guide portions 110 and the separation pad 35 (holder 510). Thereby, it is possible to prevent the sheet P from being jammed at the separation pad 35, and thus the jamming or idle feeding can be suppressed.

Further, in this exemplary embodiment, since the guide portions 110 are provided in the width direction, it is possible to securely guide the sheet P even when the sheet P is undulatedly deformed in the width direction.

As described above, according to the invention, the guide portions 110 provided to the sheet tray 31 and the extension portions 513 provided to the separation pad 35 are arranged in a line in the width direction and the upstream end portions 514 of the extension portions 513 are retreated with respect to the guide surfaces 111 of the guide portions 110. Accordingly, it is possible to prevent the jamming, idle feeding or double feeding.

The invention is effective for a structure, for example, in which the sheet tray 31 can be moved between the reception position and the separation position, like the feed device 3 of this exemplary embodiment. The reason is because, in such a structure, the position relation between the separation pad 35 and the guide portions 110 can be easily changed by adjusting the force of a user when moving the sheet tray 31 to the reception position from the separation position, and it may not be easy to always maintain the whole of the extension portions 513 retreated with respect to the guide surfaces 111.

According to the invention, the guide portion provided to the sheet accommodation unit and the extension portion provided to the separation resistance body are arranged in a line in the width direction of the sheet and the upstream end portion of the extension portion is retreated with respect to the guide surface of the guide portion. As a result, it is possible to suppress the jamming, idle feeding, double feeding and the like of the sheets.

Although the exemplary embodiments of the invention have been described, the invention is not limited thereto. The structures can be appropriately changed without departing from the scope of the invention.

Figure 9:
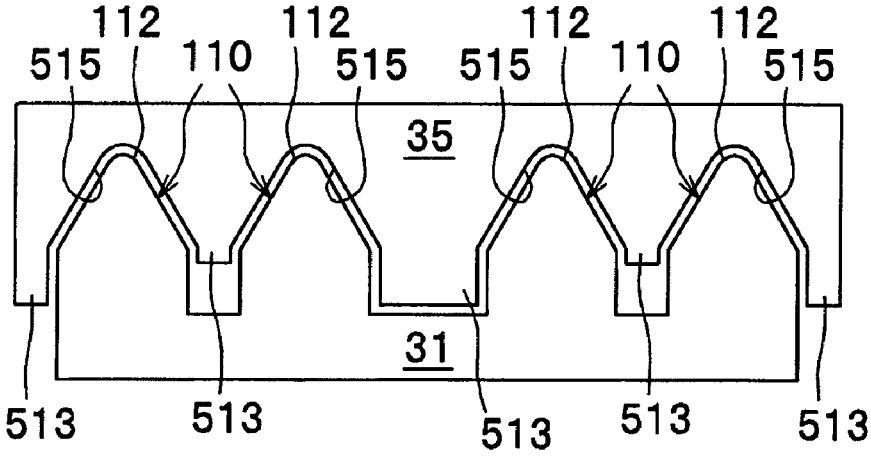
FIG. 9 shows shapes of facing portions of the extension portions and downstream end portions of the guide portions according to a modified exemplary embodiment.

In the above-described exemplary embodiments, it has been exemplified that the facing portions 515 of the separation pad 35 (holder 510) are downstream protruded to form the curved shapes. However, the invention is not limited thereto. For example, as shown in FIG. 9, the facing portions 515 of the separation pad 35 (separation resistance body) may be tapered downstream. Even with the structure, it is possible to smoothly convey the sheets P and thus to suppress the jamming or idle feeding, like the above-described exemplary embodiments.

Incidentally, in the exemplary embodiment shown in FIG. 9, the downstream end portions 112 of the guide portions 110 also have shapes (tapered shapes) following the shapes of the facing portions 515. In addition, the downstream end portions of the guide portions may have shapes different from the shapes of the facing portions.

In the above-described exemplary embodiments, it has been exemplified that the separation pad 35 (separation resistance body) can be contacted/separated to/from the separation roller 34 by supporting the holder 510 in a swingable manner. However, the invention is not limited thereto. For example, the separation resistance body may be supported to parallel translate with regard to the separation roller so as to be contacted/separated to/from the separation roller.

In the above-described exemplary embodiments, it has been exemplified that the separation roller 34 separates the sheets P, which are sent by the feed roller 3, one at a time between the separation pad 35 and the separation roller. However, the invention is not limited thereto. For example, the separation roller may have a function of a roller sending the stacked sheets.

In the above-described exemplary embodiments, the structure having the plurality of guide portions 110 and the plurality of extension portions 513 has been exemplified. However, the invention is not limited thereto. For example, one guide portion and one extension portion may be provided. Alternatively, only one of the guide portion and the extension portion may be plurally provided.

In the above-described exemplary embodiments, the sheet tray 31 that can be moved between the reception position and the separation position with regard to the body housing 2 has been exemplified as a sheet accommodation unit. However, the invention is not limited thereto. For example, the sheet accommodation unit may be configured in such a way that it cannot be moved with regard to the housing (i.e., the sheet accommodation unit may be provided in the housing).

In the above-described exemplary embodiments, the normal sheet or postcard has been exemplified as the sheet P. However, the invention is not limited thereto. For example, OHP sheets may be used.

In the above-described exemplary embodiments, the laser printer 1 has been exemplified as an image forming apparatus having the sheet feed device of the invention. However, the invention is not limited thereto. For example, a color printer is also possible. In addition, the invention is not limited to a printer. For example, the invention may also be applied to a copy machine or multi-function device.

In the above-described exemplary embodiments, it has been described that the invention is applied to the laser printer 1 (image forming apparatus). However, the invention is not limited thereto. For example, the invention may be applied to a sheet feed device that separates and feeds the stacked sheets one at a time, an apparatus having the sheet feed device and the like.

What is claimed is:

1. A sheet feed device comprising:

a sheet accommodation unit that accommodates the sheets;

a separation roller that feeds the sheets accommodated in the sheet accommodation unit; and a separation resistance body, which comprises a friction portion facing the separation roller, and which is configured to be contacted with and to be separated from the separation roller, wherein the sheet accommodation unit comprises a guide portion, which is extended along a sheet feed direction, which is provided at an upstream of the separation roller in the sheet feed direction, and which comprises a guide surface that guides the sheets, wherein the separation resistance body comprises a protruding portion, which protrudes upstream in the sheet feed direction from an upstream end portion of the separation resistance body, wherein the guide portion and the protruding portion are aligned in a width direction that is substantially perpendicular to the sheet feed direction, wherein a portion of the guide portion overlaps a portion of the protruding portion in the width direction at least when feeding the sheets, wherein an upstream end portion of the protruding portion in the sheet feed direction is retreated with regard to the guide surface of the guide portion at least when feeding the sheets, and wherein a downstream end portion of the guide portion in the sheet feed direction is curved in a downstream sheet feed direction.

2. The sheet feed device according to claim 1, wherein the separation resistance body comprises a facing portion, and wherein the facing portion faces the upstream end portion of the guide portion and has a curved shape following the shape of the guide portion.

3. The sheet feed device according to claim 1, wherein the sheet accommodation unit comprises a plurality of the guide portions arranged in the width direction, and wherein the separation resistance body comprises a plurality of the protruding portion.

4. The sheet feed device according to claim 1, further comprising a housing, wherein the separation roller is provided to the housing, wherein the separation resistance body is provided to the sheet accommodation unit, and wherein the sheet accommodation unit is configured to move with regard to the housing between a reception position, at which the separation resistance body is pressed by the separation roller, and a separation position, at which the separation resistance body is spaced from the separation roller.

5. The sheet feed device according to claim 1, wherein the width direction corresponds to a width direction of the sheet.

6. The sheet feed device according to claim 1, further comprising:

a feed roller that feeds sheets from the sheet accommodation unit toward the separation pad.

7. The sheet feed device according to claim 6, wherein the guide portion is extended downstream in the sheet feed direction from a front end portion of the stacked sheet for guiding the sheet fed by the feed roller toward the separation roller.

8. A sheet feed device comprising:

a sheet accommodation unit that accommodates the sheets;

a separation roller that feeds the sheets accommodated in the sheet accommodation unit; and a separation resistance body, which comprises a friction portion facing the separation roller, and which is configured to be contacted with and to be separated from the separation roller, wherein the sheet accommodation unit comprises a guide portion, which is extended along a sheet feed direction, which is provided upstream of the separation roller in the sheet feed direction, and which comprises a guide surface that guides the sheets, wherein the separation resistance body comprises a protruding portion, which protrudes upstream in the sheet feed direction from an upstream end portion of the separation resistance body, wherein the guide portion and the protruding portion are aligned in a width direction that is substantially perpendicular to the sheet feed direction, wherein a portion of the guide portion overlaps a portion of the protruding portion in the width direction at least when feeding the sheets, wherein an upstream end portion of the protruding portion in the sheet feed direction is retreated with regard to the guide surface of the guide portion at least when feeding the sheets, and wherein a downstream end portion of the guide portion in the sheet feed direction is tapered in a downstream sheet feed direction.

9. The sheet feed device according to claim 8, wherein the separation resistance body comprises a facing portion, and wherein the facing portion is tapered along with the guide portion in the downstream sheet feed direction.

10. A sheet feed device comprising:

a sheet accommodation unit that accommodates the sheets;

a separation roller that feeds the sheets accommodated in the sheet accommodation unit; and a separation resistance body, which comprises a friction portion facing the separation roller, and which is configured to be contacted with and to be separated from the separation roller, wherein the sheet accommodation unit comprises a guide portion, which is extended along a sheet feed direction, which is provided upstream of the separation roller in the sheet feed direction, and which comprises a guide surface that guides the sheets, wherein the separation resistance body comprises a protruding portion, which protrudes upstream in the sheet feed direction from an upstream end portion of the separation resistance body, wherein the guide portion and the protruding portion are aligned in the width direction that is substantially perpendicular to the sheet feed direction, wherein the guide portion and the protruding portion are alternately arranged in the width direction, wherein an upstream end portion of the protruding portion in the sheet feed direction is retreated with regard to the guide surface of the guide portion at least when feeding the sheets, and wherein each of a plurality of the guide portions and each of a plurality of the protruding portions are alternately arranged in the width direction.

11. The sheet feed device according to claim 10, wherein the protruding portion is configured to move independently from the guide portion.

12. A sheet feed device comprising:

a sheet accommodation unit that accommodates the sheets;

a separation roller that feeds and supplies the sheets accommodated in the sheet accommodation unit; and a separation resistance body, which comprises a friction portion, and which is configured to be contacted with and to be separated from the separation roller, wherein the sheet accommodation unit comprises a guide portion, which extends upstream of a sheet feed direction, which is provided upstream of the separation roller in the sheet feed direction, and which comprises a guide surface that guides the sheets, wherein the separation resistance body comprises a protruding portion, which extends downstream in the sheet feed direction from an upstream end portion of the separation resistance body, wherein the guide portion and the protruding portion are aligned in a width direction that is substantially perpendicular to the sheet feed direction, wherein the guide portion and the protruding portion are provided at the upstream of the friction portion and within a width of the friction portion, wherein a portion of the guide portion overlaps a portion of the protruding portion in the width direction at least when feeding the sheets, and wherein an upstream end portion of the protruding portion in the sheet feed direction is retreated with regard to the guide surface of the guide portion at least when feeding the sheets.

* * * * *